US006364641B2

(12) United States Patent
Mori

(10) Patent No.: US 6,364,641 B2
(45) Date of Patent: Apr. 2, 2002

(54) FUEL INJECTION PUMP

(75) Inventor: Katsumi Mori, Chiryu (JP)

(73) Assignee: Denso Corporation, Kariys (JP)

( * ) Notice: Subject to any disclaimer, the term of this patent is extended or adjusted under 35 U.S.C. 154(b) by 0 days.

(21) Appl. No.: 09/725,145

(22) Filed: Nov. 29, 2000

(30) Foreign Application Priority Data

Dec. 28, 1999 (JP) ..... 11-373538
Oct. 16, 2000 (JP) ..... 2000-314990

(51) Int. Cl.[7] ..... F04B 39/10; F04B 53/10
(52) U.S. Cl. ..... 417/569; 239/533.3; 138/177
(58) Field of Search ..... 417/273, 462, 417/214, 569; 123/450, 447, 467, 139, 506, 503; 138/177; 339/533.3

(56) References Cited

U.S. PATENT DOCUMENTS 3,883,270 A * 5/1975 Baxter ..... 417/214
4,200,072 A * 4/1980 Bailey ..... 123/450
4,499,884 A * 2/1985 Skinner ..... 123/506
5,044,898 A * 9/1991 Harris ..... 417/462
5,192,026 A 3/1993 Rix et al.
5,209,208 A * 5/1993 Siebert et al. ..... 123/503
5,540,564 A * 7/1996 Klopfer ..... 417/273
5,685,275 A * 11/1997 Djordjevic ..... 123/467
5,819,808 A * 10/1998 Smith ..... 138/177
6,152,109 A * 11/2000 Melchior ..... 123/447
6,289,875 B1 * 9/2001 Shinohara et al. ..... 123/450
6,302,659 B1 * 10/2001 Parker et al. ..... 417/273

* cited by examiner

*Primary Examiner*—Teresa Walberg
*Assistant Examiner*—Leonid Fastovsky
(74) *Attorney, Agent, or Firm*—Nixon & Vanderhye P.C.

(57) ABSTRACT

In a fuel injection pump, flat sections are provided around a connecting segment located between an inner wall surface of a pump housing defining a fuel pressurizing chamber and an inner wall surface of a fuel intake passage as well as a connecting segment located between the wall surface of the pump housing and an inner wall surface of a fuel discharge passage 15 to spread stresses concentrated in upper and lower intersecting points of each connecting segment over an entire periphery of the connecting segment. As a result, the strength of the fuel injection pump is improved to allow use of higher fuel injection pressures. Furthermore, the strength of the fuel injection pump is improved without increasing a wall thickness of the pump housing, so that a size of the fuel injection pump is not increased.

6 Claims, 8 Drawing Sheets

FUEL INJECTION PUMP

CROSS-REFERENCE TO RELATED APPLICATION

The present invention is related to Japanese patent application No. Hei. 11-373538, filed Dec. 28, 1999; 2000-314990, filed Oct. 16, 2000, the contents of which are incorporated herein by reference.

FIELD OF THE INVENTION

The present invention relates to a fuel injection pump for an internal combustion engine, and more particularly, to a fuel injection pump having increased strength characteristics.

BACKGROUND OF THE INVENTION

In conventional fuel injection pumps, a movable member, such as a plunger, reciprocates in a pump housing cylinder to pressurize fuel. This fuel is pressurized in a fuel pressurizing chamber, defined within the cylinder, between the pump housing and the plunger. The fuel is sucked into the pressurizing chamber from a fuel intake passage as the plunger slides downward in the cylinder. The fuel is then discharged from the pressurizing chamber into a fuel discharge passage as the plunger slides upward in the cylinder, thereby pressurizing the fuel. The discharged high pressure fuel is thereafter supplied to and accumulated in a common rail.

In a known diesel engine having this common rail fuel system, the fuel is pressurized to approximately 180 MPa by the fuel injection pump. Stresses induced by the relatively high fuel pressure are mainly concentrated in corners of the pressurizing chamber.

During fuel pressurization, an inner cylindrical wall surface of the pressurizing chamber as well as an inner cylindrical wall surface of the fuel intake passage and of the fuel discharge passage (these passages are collectively referred as a fuel passage) are subjected to a radial pressure force due to high pressure fuel therein. Therefore, a connecting segment between the inner wall surface of the pressurizing chamber and the inner wall surface of the fuel intake passage as well as a connecting segment between the inner wall surface of the pressurizing chamber and the inner wall surface of the fuel discharge passage experience large tensile force.

Since these connecting segments are located in the cylindrical inner wall surface of the pressurizing chamber, stress applied to each connecting segment due to tensile force is mainly concentrated at intersecting points (axial intersecting points) between the connecting segment and a longitudinal central axis of the connecting segment that extends through a center of the connecting segment in an axial direction with respect to the pressurizing chamber.

To provide a structure capable of withstanding such a stress, the wall of the pump housing around the cylinder can be thickened or can be made of a stronger material. However, an increase in the wall thickness of the pump housing generally causes an increase in the size of the fuel injection pump. Furthermore, the use of the stronger material, which is usually more expensive, generally causes an increase in the manufacturing cost of the fuel injection pump.

Alternatively, the connecting segments may be chamfered to spread the stresses. In order to chamfer the connecting segments, a small diameter electrode needs to be placed adjacent to the connecting segment to permit electric discharge between the electrode and the connecting segment to remove material from the connecting segment. Alternatively, a slurry containing an abrasive agent needs to be passed through the fuel intake passage and the fuel discharge passage to polish the corners within these passages and connecting segments. However, in the electric discharge machining process, since the electrode and other processing tools have very small diameters, very precise control of these tools is required. Also, the polishing process with the slurry is time consuming and tedious.

Furthermore, higher fuel injection pressures (for example, 200 MPa or more) are required to meet more stringent future emission regulations. In such a case, the described processes cannot provide adequate connecting segments able to withstand the stresses induced by the higher fuel injection pressures.

SUMMARY OF THE INVENTION

The present invention provides a fuel injection pump having improved strength and using higher fuel injection pressures without increasing the size of the fuel injection pump. Here, a stress spreading means is provided at a connecting segment between a first cylindrical inner surface, defining a fuel pressurizing chamber, and a second cylindrical inner surface, defining a fuel passage in a pump housing. The stress spreading means is arranged to contain the axial intersecting points of the connecting segment. The stress spreading means spreads the stresses concentrated in the axial intersecting points over adjacent regions of the axial intersecting points. Therefore, it is not necessary to increase the wall thickness of the cylinder or to use a stronger material for the cylinder wall to improve the strength of the connecting segment. As a result, the strength of the fuel injection pump can be effectively improved at low cost without increasing the size of the fuel injection pump, allowing the use of higher fuel injection pressures.

In another aspect of the present invention, the stress spreading means is a flat section that extends perpendicular to an axis of the fuel passage. Since the stress spreading means is flat, more of the connecting segment is located in a single plane compared to where the connecting segment is located in the cylindrical surface. Therefore, the stresses concentrated in the axial intersecting points can be spread over the entire connecting segment located in the flat section, alleviating the stress concentration at the axial intersecting points. As a result, the strength of the fuel injection pump can be improved with by using a simple structure.

In another aspect of the present invention, the stress spreading means is a curved section having a radius of curvature that is greater than the inner wall surface of the pressurizing chamber. By making the curved section radius of curvature larger than the first cylindrical inner surface that defines the pressurizing chamber, the connecting segment is located in the less curved surface. Therefore, the stresses concentrated in the axial intersecting points can be spread over the less curved connecting segment, alleviating the stress concentration on the axial intersecting points. As a result, the strength of the fuel injection pump can be improved with this simple structure.

In another aspect, the stress spreading means contains the entire periphery of the connecting segment. Therefore, the stresses concentrated in the axial intersecting points is spread over the entire periphery of the connecting segment. As a result, the strength of the fuel injection pump can be improved.

While the above-described embodiments refer to examples of usage of the present invention, it is understood that the present invention may be applied to other usage, modifications and variations of the same, and is not limited to the disclosure provided herein.

BRIEF DESCRIPTION OF THE DRAWINGS

The present invention will become more fully understood from the detailed description and the accompanying drawings, wherein.

DETAILED DESCRIPTION OF THE INVENTION

Figure 1A:
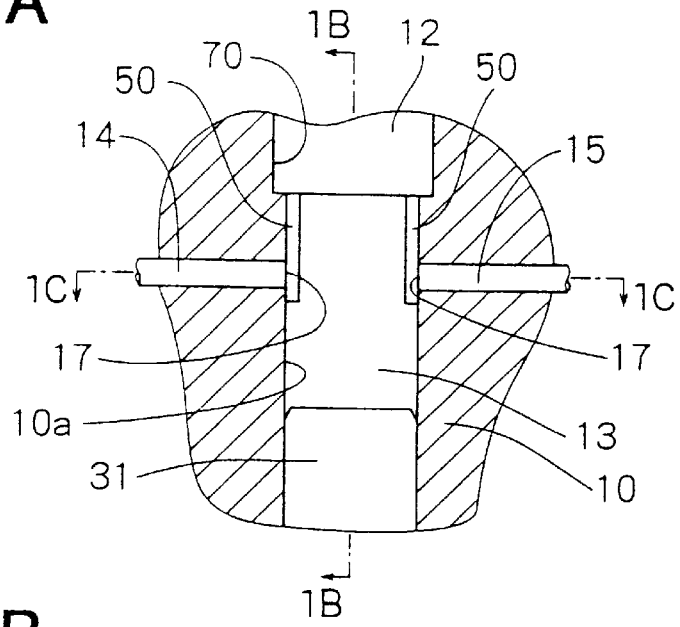
FIG. 1A is s cross-sectional view of a portion of a fuel injection pump showing a fuel pressurizing chamber for a fuel injection pump according to a first embodiment of the present invention.
Figure 1B:
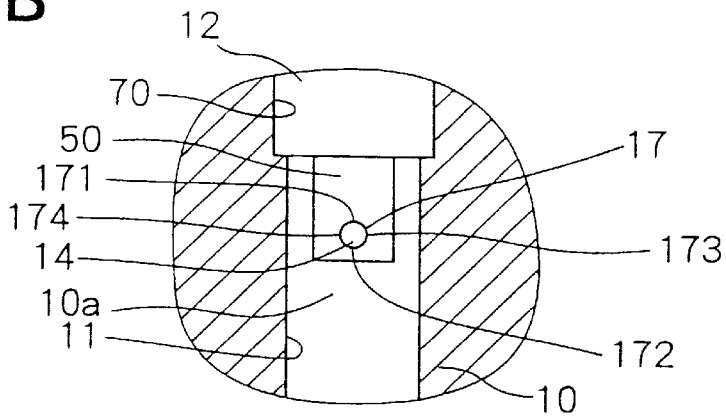
FIG. 1B is a cross-sectional view taken along line 1B—1B in FIG. 1A for a fuel injection pump according to the present invention.
Figure 1C:
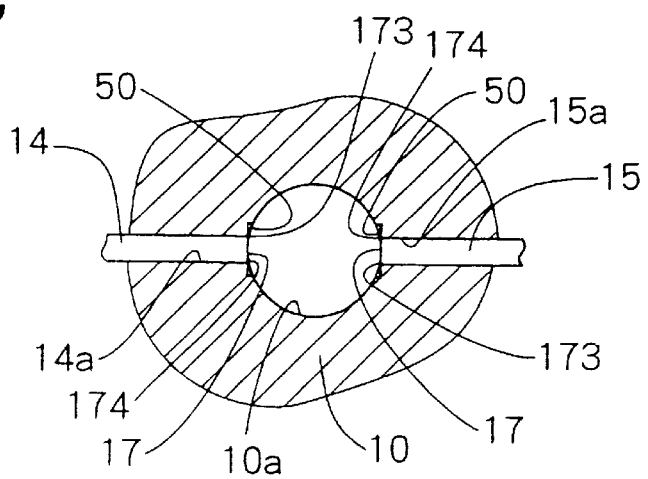
FIG. 1C is a cross-sectional view taken along line 1C—1C in FIG. 1A for a fuel injection pump according to the present invention.
Figure 2:
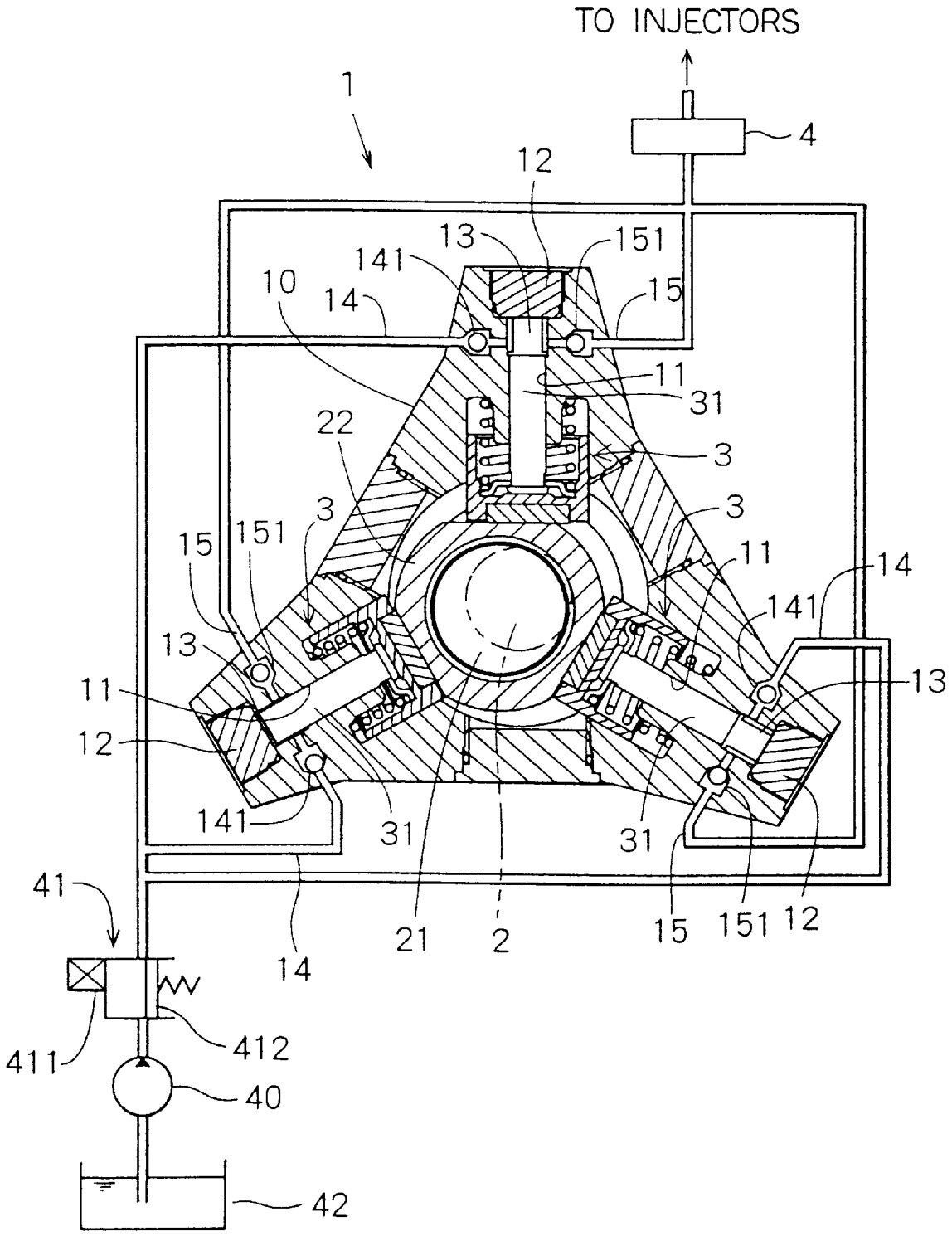
FIG. 2 is a cross-sectional view showing the fuel injection pump and a fuel supply system for a fuel injection pump according to the present invention.
Figure 3:
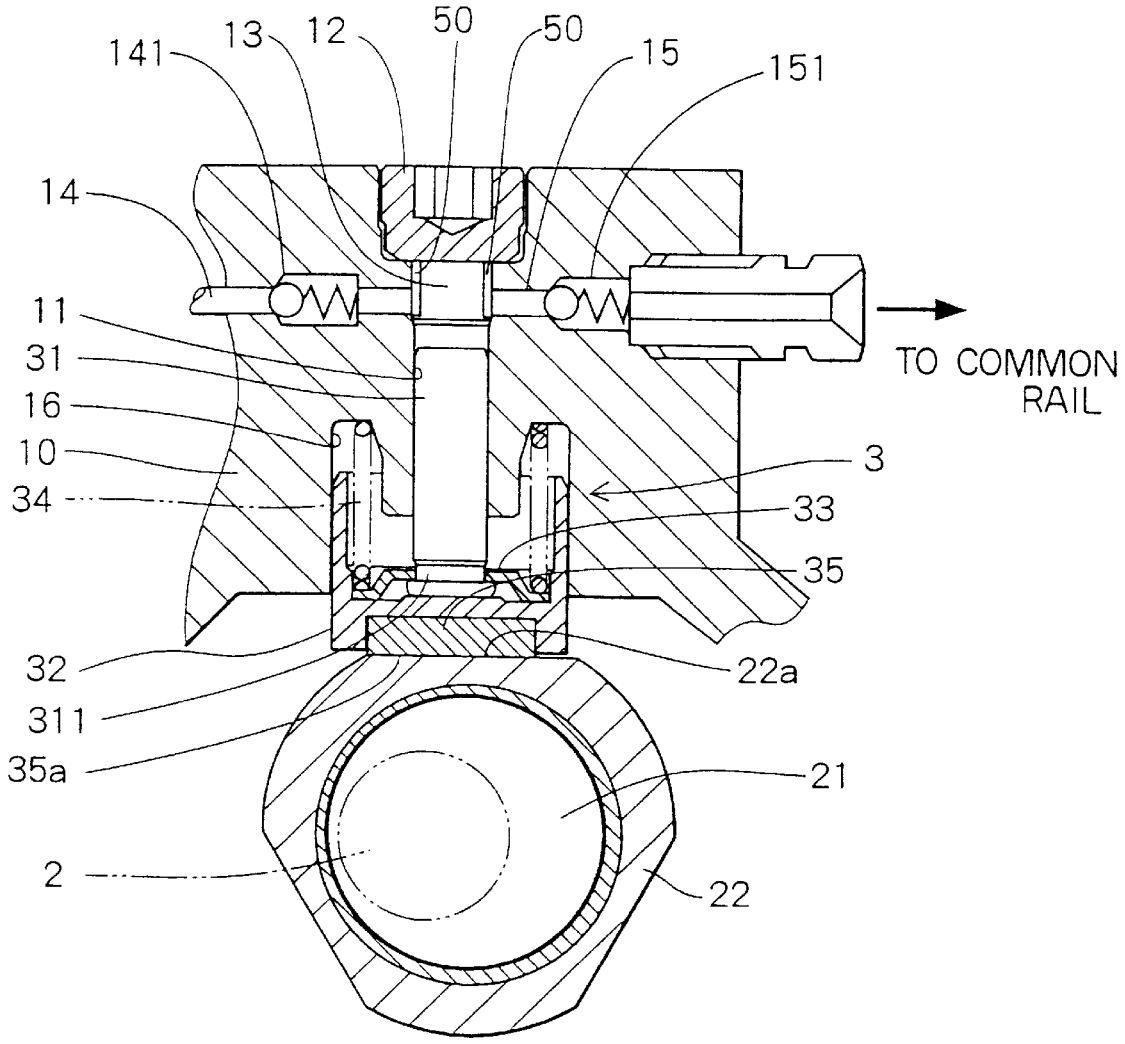
FIG. 3 is a cross-sectional view of a fuel injection pump according to the present invention.

A fuel injection pump according to a first embodiment of the present invention is shown in FIGS. 1–3. As shown in FIG. 2, the fuel injection pump 1 is a radial pump for use with a diesel engine. The fuel injection pump 1 has three movable members 3 angularly positioned around a drive shaft 2 at 120 degree intervals. FIG. 3 shows one of the movable members 3 on a larger scale.

The drive shaft 2 of the fuel injection pump 1 is rotatably supported in a pump housing 10 by bearing journals (not shown). A cam 21 is integrally formed with the drive shaft 2 and has an annular cam ring 22 fitted therearound. A plunger 31 of each movable member 3 is reciprocally received in a corresponding cylinder 11 formed in the pump housing 10. An opening at one end of the cylinder 11 is sealed by a sealing plug 12.

A fuel pressurizing chamber 13 is defined by an inner wall surface 10*a* that constitutes a first cylindrical inner surface of the pump housing 10, an outer end surface of the plunger 31 and an inner end surface of the sealing plug 12. The pressurizing chamber 13 is in communication with a fuel intake passage 14 and a fuel discharge passage 15, which are collectively referred as a fuel passage. A check valve 141, 151 is provided in the respective passages 14, 15 to prevent reverse fuel flow. An inner wall surface 14*a* of the fuel intake passage 14 and an inner wall surface 15*a* of the fuel discharge passage 15 cooperatively constitute a second cylindrical inner surface of the present invention.

As shown in FIG. 2, downstream of a metering valve 41, which is downstream of a feed pump 40, the fuel intake passage 14 branches into three fuel intake passages 14, each leading to the corresponding pressurizing chamber 13. The metering valve 41 is a solenoid valve that meters fuel supplied from a fuel tank 42 to the pressurizing chambers 13 through the feed pump 40 based on the running condition of the engine. The metering valve 41 has a solenoid 411 and a valve element 412. The amount of the fuel supplied to the pressurizing chambers 13 is adjusted by controlling an aperture size in the metering valve 41. This is, in turn, controlled by adjusting the position of the valve element 412 by controlling the amount of control electric current supplied to the solenoid 411.

The fuel pressurized in each pressurizing chamber 13 is discharged from the pressurizing chamber 13 and is supplied to the common rail 4 through the fuel discharge passage 15 and the check valve 151. The common rail 4 accumulates the fuel and provides the fuel at a constant pressure. The fuel discharged from the common rail 4 is then supplied to injectors (not shown).

Each movable member 3 has the plunger 31, a tappet 32 and a lower sheet 33. As shown in FIG. 3, the plunger 31 is urged against the tappet 32 by a spring 34 via the lower sheet 33 that is fitted around a reduced diameter section 311 of the plunger 31. The plunger 31 is reciprocated by the cam 21 via the cam ring 22 and the tappet 32 as the drive shaft 2 is rotated. As the plunger 31 slides down toward the drive shaft 2, the fuel is sucked into the pressurizing chamber 13 through the fuel intake passage 14. Then, as the plunger 31 slides up away from the drive shaft 2, the sucked fuel is pressurized in the pressurizing chamber 13 and is discharged through the fuel discharge passage 15.

The tappet 32 is reciprocally received in a housing hole 16 defined radially outward of the cylinder 11 in the pump housing 10. The tappet 32 is cylindrical and has a substantially H-shaped longitudinal cross-section. On the outer side of the tappet 32, the plunger 31 is supported. Furthermore, a tappet shoe 35 is press fitted into a recess formed on the inner side of the tappet 32.

The tappet shoe 35 is arranged to reduce friction between the tappet 32 and the cam ring 22 by providing a sliding surface 35*a* that slides along a contact surface 22*a* of the cam ring 22.

The stress spreading means of the present invention will now be described. As shown in FIG. 1A, in the inner wall surface 10*a* of the pump housing 10, flat sections 50 are provided that spread stress generated in a connecting segment located between the inner wall surface 10*a* and the inner wall surface 14*a* of the fuel intake passage 14. Flat sections 50 also spread stress generated in a connecting segment located between the inner wall surface 10*a* and the inner wall surface 15*a* of the fuel discharge passage 15. In the fuel injection pump 1 shown in FIG. 3, each flat section 50 extends from the inner end of the sealing plug 12 toward the plunger 31. As shown in FIG. 1A, at the outer end of the pump housing 10, there is a receiving hole 70 for receiving the sealing plug 12. The receiving hole 70 has a diameter larger than that of the pressurizing chamber 13.

As shown in FIG. 1B, each flat section 50 contains upper and lower intersecting points 171, 172 that are intersecting points between the connecting segment 17 and a longitudinal central axis of the connecting segment 17 that extends through a center of the connecting segment 17 in an axial direction of the pressurizing chamber 13. The flat section 50 also contains lateral side intersecting points 173, 174 that are intersecting points between the connecting segment 17 and a lateral central axis of the connecting segment 17 that extends through the center of the connecting segment 17 in a direction perpendicular to the axial direction of the pressurizing chamber 13. Furthermore, each flat section 50 extends in a direction perpendicular to a longitudinal axis of the corresponding fuel inlet passage 14 or of the fuel discharge passage 15.

The upper and lower intersecting points 171, 172 of the connecting segment 17 are located within the flat section 50, so that the stresses acting on the upper and lower intersecting points 171, 172 of the connecting segment 17 can be spread more effectively compared to where no flat section 50 is provided. The flat sections 50 can be formed, for example, by machining, electro-chemical machining or electric discharge machining.

As described above, each flat section 50 extends from the inner end of the sealing plug 12 toward the plunger 31. Furthermore, the receiving hole 70, which has a diameter larger than that of the pressurizing chamber 13, for receiving the sealing plug 12 is formed at the outer end of the pump housing 10.

Therefore, when the flat sections 50 are manufactured, for example by electro-chemical or electric discharge machining, an end mill, electrode or the like can be inserted through the wider receiving hole 70 rather than direct insertion into the smaller cylinder constituting the pressurizing chamber 13. That is, processing tools can be advantageously inserted through the wider space during manufacturing of the flat sections 50. Therefore, the flat sections 50 can be easily manufactured in a stable manner. As such, during formation of the flat sections 50 around the connecting segments 17 by this machining, an end mill, electrode or the like is inserted through a receiving hole 70 (having a larger diameter than pressurizing chamber 90). As such, wider hole 70 allows ease of manufacturing.

Figure 4A:
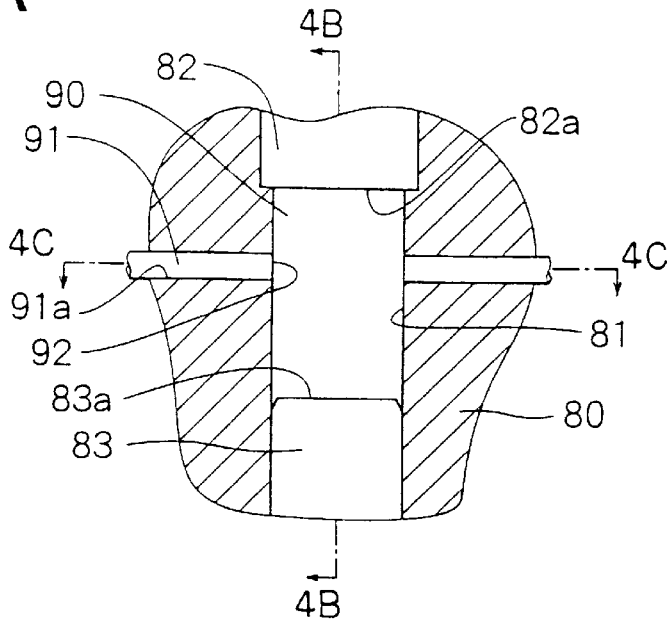
FIG. 4A is an enlarged partial cross-sectional view of a fuel injection pump, showing a fuel pressurizing chamber having no stress spreading means.
Figure 4B:
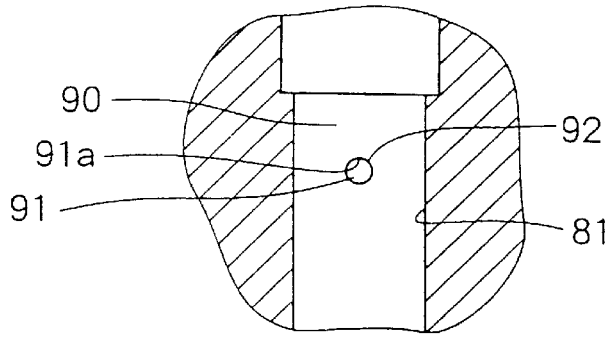
FIG. 4B is a cross-sectional view taken along line 4B—4B in FIG. 4A for a fuel injection pump according to the present invention.
Figure 4C:
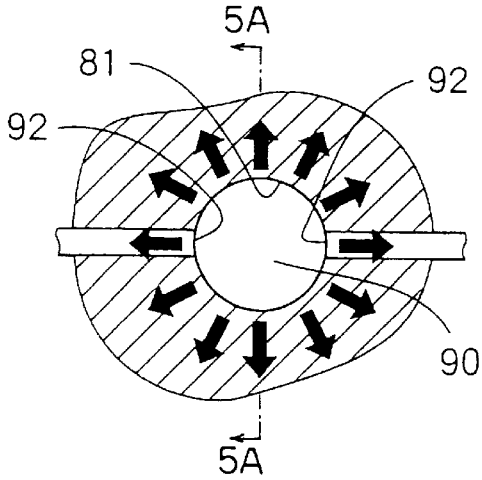
FIG. 4C is a cross-sectional view taken along line 4C—4C in FIG. 4A for a fuel injection pump according to the present invention.

Various stress inducing factors around the connecting segments 17 as well as advantages of the flat sections 50 will now be described. For comparative reasons, a fuel injection pump without the pressure spreading means or the flat section 50 is illustrated in FIGS. 4–6. Except the flat sections 50, the components shown in FIGS. 4–6 are substantially the same as those described with reference to FIGS. 1–3. Furthermore, the following discussion is mainly focused on various forces developed in the pressurizing chamber 90 and the fuel intake passage 91 during the fuel pressurization in the pressurizing chamber 90, and therefore discussion of the fuel discharge passage is skipped for simplicity. As the fuel is pressurized in the pressurizing chamber 90, a radial pressure force directed radially outward from a center of the pressurizing chamber 90 is applied to the inner wall surface 81 of the pump housing 80, as shown in FIG. 4C. At the same time, an axial pressure force directed in an axial direction of the pressurizing chamber 90 is generally applied to the inner end surface 82*a* of the sealing plug 82 and the outer end surface 83*a* of the plunger 83 and is not directly applied to the pump housing 80.

Figure 5A:
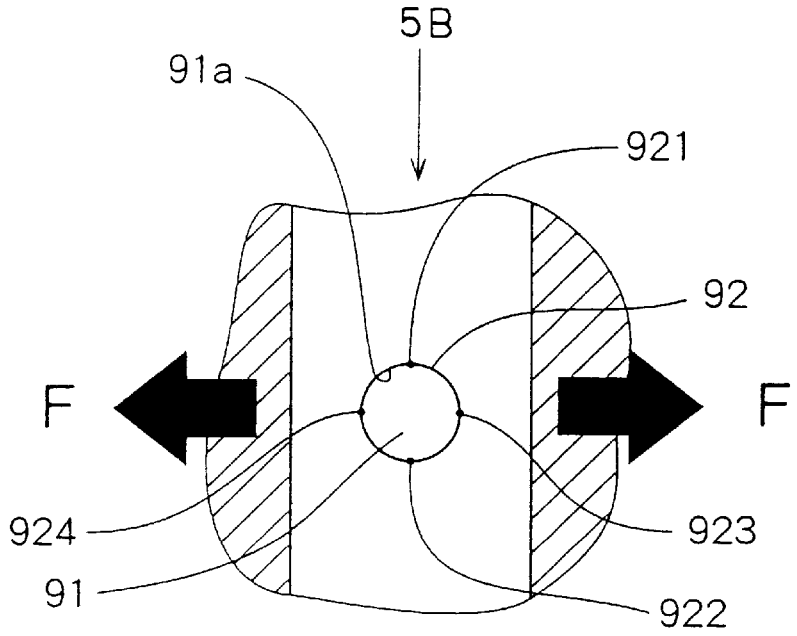
FIG. 5A is an enlarged cross-sectional view taken along line 5A—5A in FIG. 4C for a fuel injection pump according to the present invention.
Figure 6:
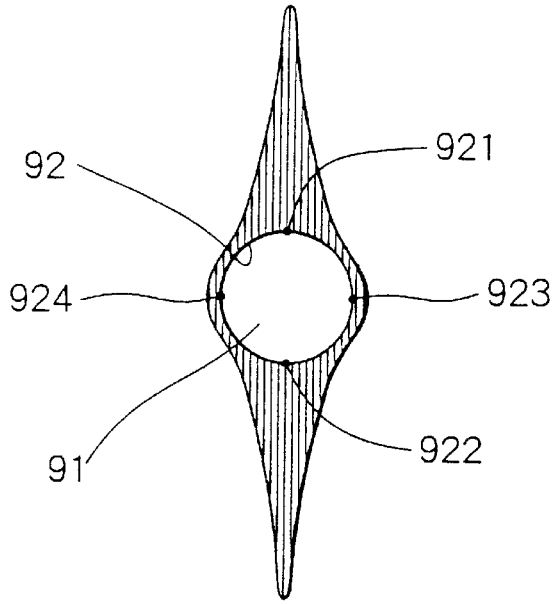
FIG. 6 is a diagram showing stress distribution around a connecting segment in the fuel injection pump shown in FIG. 4 for a fuel injection pump according to the present invention.

With reference to FIG. 5A showing a cross-sectional view taken along line 5A—5A in FIG. 4C, the radial pressure force shown in FIG. 4C causes a tensile force F in the pump housing 80 perpendicular to a longitudinal central axis of the connecting segment 92 that extends through a center of the connecting segment 92 in an axial direction of the pressurizing chamber 90.

Furthermore, a radial pressure force directed from a center of the fuel intake passage 91 is applied to the inner wall surface 91*a* of the fuel intake passage 91 as well as to the connecting segment 92 during the fuel pressurization.

Figure 5B:
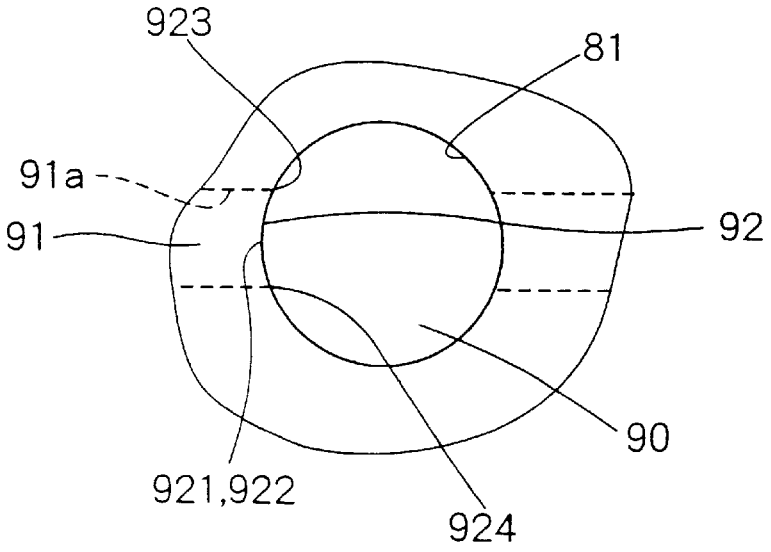
FIG. 5B is a view taken in a direction of the arrow 5B in FIG. 5A for a fuel injection pump according to the present invention.

With reference to FIGS. 5A and 5B, since the connecting segment 92 is arranged in the cylindrical inner wall surface 81 of the pump housing 80, the upper and lower intersecting points 921, 922 are not located on the same plane as the lateral side intersecting points 923, 924. This arrangement of the connecting segment 92 causes the stress in the pump housing 10, which is induced by the tensile force F, to be more concentrated in the upper and lower intersecting points 921, 922 than on the lateral side intersecting points 923, 924. An example stress distribution pattern of the connecting segment 92 is shown in FIG. 6.

Figure 7:
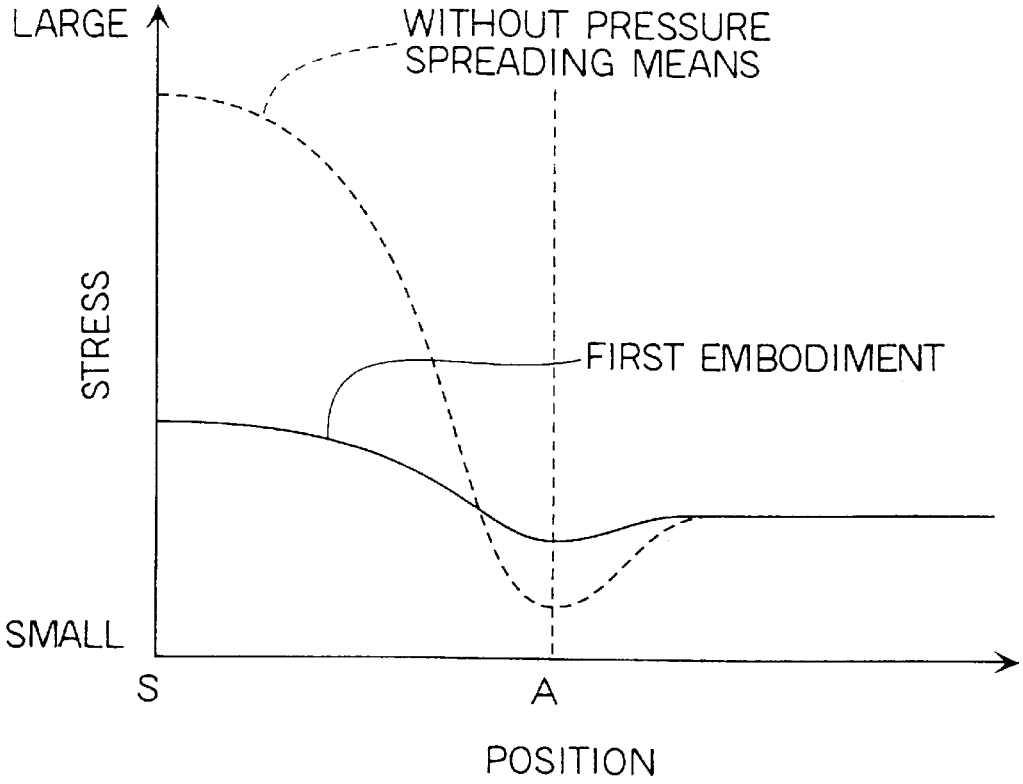
FIG. 7 is a graphical view showing the stress spreading means on the stress generated in the connecting segment for a fuel injection pump according to the present invention.

FIG. 7 shows a graph indicative of stress distribution around the connecting segment 92, wherein the upper intersecting point 921 and the lateral side intersecting point 923 of the connecting segment 92 are indicated by "S" and "A", respectively. In FIG. 7, the stress at point A is reduced. This is due to the generation of a compressive load in a direction perpendicular to the axis of the pressurizing chamber 90 induced by the concentration of the stress around the point S or the upper intersecting point 921 (and also around the lower intersecting point 922).

Figure 8:
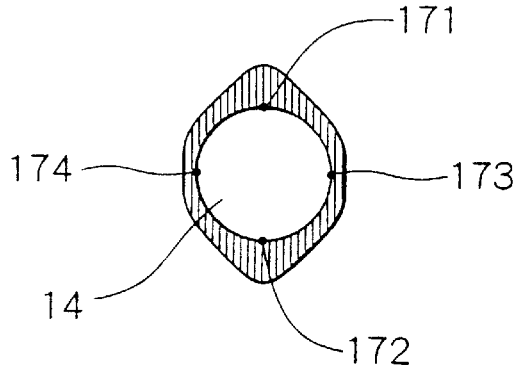
FIG. 8 is an illustrative diagram showing stress distribution around a connecting segment for a fuel injection pump according to the present invention.

If the stress spreading means or the flat section 50 is provided around the connecting segment 17 as in the fuel injection pump 1 of the present embodiment shown in FIGS. 1–3, the stresses at the upper and lower intersecting points 171, 172 in the connecting segment 17 is reduced, as indicated by a solid line in FIG. 7. This is due to the fact that since the connecting segment 17 is located within the flat section 50, the tensile force is more equally spread over the entire peripheral of the connecting segment 17 in comparison to where the connecting segment 17 is formed on the curved surface, as previously described, so that the stress induced by the tensile force is also spread over the entire periphery of connecting segment 17, as shown by the solid line in FIG. 7 and the shaded area in FIG. 8.

As described above, in accordance with the first embodiment, the flat section 50 around the connecting segment 17 advantageously spreads the concentrated stress at the upper and lower intersecting points 171, 172 over the entire peripheral of the connecting segment 17. Therefore, the strength of the fuel injection pump 1 is improved, allowing an increase in the fuel injection pressure. Since the strength of the fuel injection pump 1 is improved without increasing the wall thickness of the pump housing 10, an increase in the size of the fuel injection pump 1 is advantageously avoided.

Figure 9:
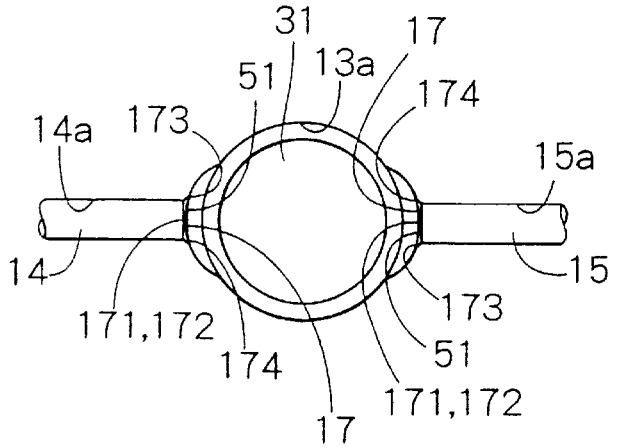
FIG. 9 illustrates the connecting segments and their surrounding regions in the fuel injection pump according to the present invention.

A second embodiment of the present invention is shown in FIG. 9. It should be noted that the component parts similar to those described in the first embodiment are indicated by the same reference numerals and will not be discussed further. As shown in FIG. 9, the geometry of the stress spreading means in this embodiment differs from that of the first embodiment. The stress spreading means in the second embodiment is a curved section 51 having a radius of curvature that is greater than that of the inner wall surface 10*a* of the pump housing 10 around the connecting segment 17. In the curved surfaces located on the left and right lateral sides of the curved section 51, respectively, the radius of curvature is decreased to merge with the inner wall surface 10*a*. Similar to the first embodiment, the curved section 51 includes the upper and lower intersecting points 171, 172 as well as the lateral side intersecting points 173, 174 of the connecting segment 17.

The stresses concentrated at the upper and lower intersecting points 171, 172 of the connecting segment 17 are more effectively spread over the curved section 51 in comparison to the case shown in FIGS. 4–6 by making the radius of curvature of the curved section 51 larger than that of the inner wall surface 10*a* of the pressurizing chamber 13. As a result, the concentrated stresses at the upper and lower intersecting points 171, 172 are spread over the connecting segment 17, so that the stress concentrations at the upper and lower intersecting points 171, 172 can be advantageously avoided.

Figure 10:
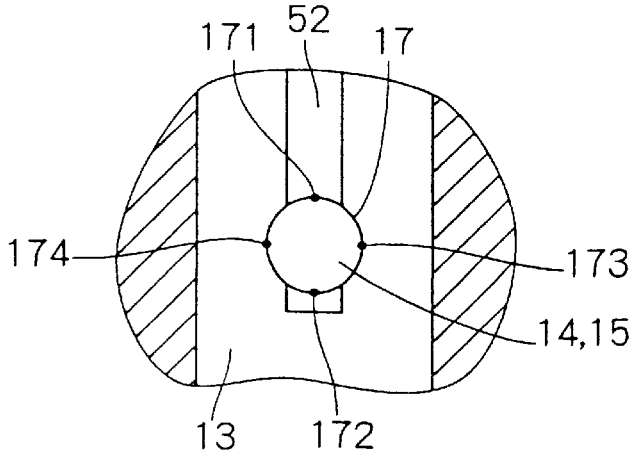
FIG. 10 illustrates the connecting segment and its surrounding region in the fuel injection pump for a fuel injection pump according to the present invention.

A third embodiment of the present invention is shown in FIG. 10. It should be noted that the component parts similar to those described in the first embodiment are indicated by the same reference numerals and will not be discussed further.

As shown in FIG. 10, the location of the stress spreading means in accordance with the third embodiment of the present invention differs from that of the first embodiment.

In the fuel injection pump 1 according to the third embodiment, the flat section 52 or the stress spreading means is provided only around the upper and lower intersecting points 171, 172 of the connecting segment 17. More particularly, the flat section 52 contains the upper and lower cross sections 171, 172 but does not contain the lateral side intersecting points 173, 174.

The concentrated stresses at the upper and lower intersecting points 171, 172 can be spread over the entire periphery of the connecting segment 17 by making the flat section 52 around the upper and lower intersecting points 171, 172. As a result, the stress concentrations at the upper and lower intersecting points 171, 172 can be advantageously avoided.

Figure 11:
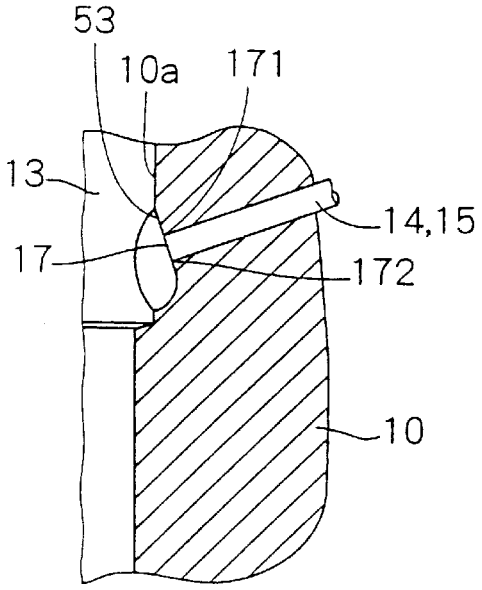
FIG. 11 illustrates a connecting segment for a fuel injection pump according to the present invention.

A fourth embodiment of the present invention is shown in FIG. 11. It should be noted that the component parts similar to those described in the first embodiment are indicated by the same reference numerals and will not be discussed further. As shown in FIG. 11, in the fuel injection pump 1 according to the fourth embodiment of the present invention, the locations of the fuel intake passage 14 and the fuel discharge passage 15 differ from those of the first embodiment. In the fuel injection pump 1 according to the fourth embodiment, the axes of the fuel intake passage 14 and the fuel discharge passage 15 are angled at a predetermined angle relative to the axis of the pressurizing chamber 13.

In the fourth embodiment, each flat section 53 extends in a direction perpendicular to the axis of the fuel intake passage 14 or of the fuel discharge passage 15. Therefore, similar to the first embodiment, the stresses concentrated at the upper and lower intersecting points 171, 172 of each connecting segment 17 can be spread.

Figure 12:
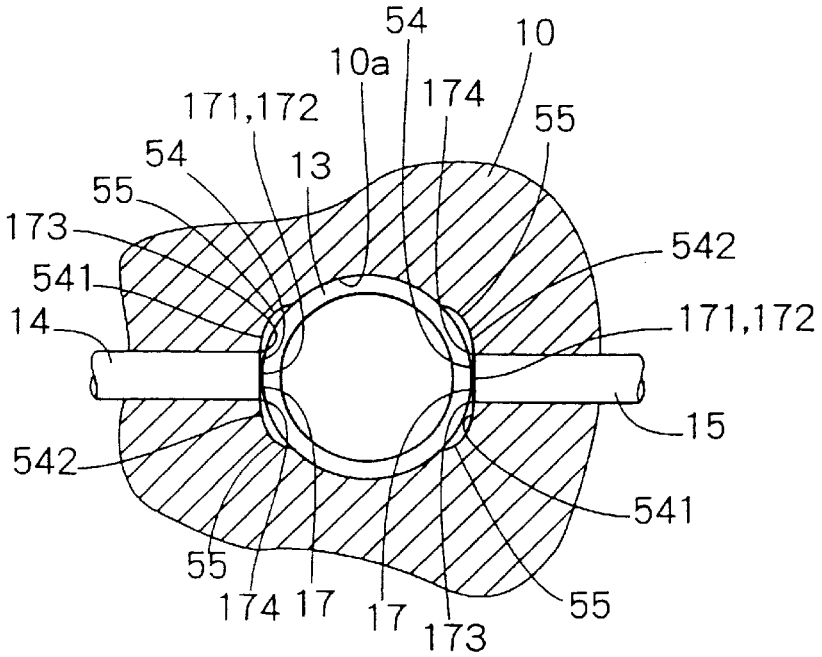
FIG. 12 is a view similar to FIG. 1C, illustrating the connecting segments and their surrounding regions in the fuel injection pump according to a fifth embodiment of the present invention.

A fifth embodiment of the present invention is shown in FIG. 12. It should be noted that the component parts similar to those described in the first embodiment are indicated by the same reference numerals and will not be discussed further. As shown in FIG. 12, in the fuel injection pump 1 according to the fifth embodiment of the present invention, the geometry of the stress spreading means differs from that of the first embodiment. In the fuel injection pump 1 according to the fifth embodiment, the flat section 54 is provided as the stress spreading means. Similar to the first embodiment, the flat section 54 contains the upper and lower intersecting points 171, 172 as well as the lateral side intersecting points 173, 174.

At the boundary regions where the lateral edges 541, 542 of the flat section 54 merge with the inner wall surface 10*a* of the pump housing 10, chamfered sections 55 are provided. The corners in the pressurizing chamber 13 are advantageously reduced by arranging the chamfered sections 55 in the boundary regions. As a result, the stress concentrations at the corners of the pressurizing chamber 13 are alleviated, and therefore the strength of the fuel injection pump is improved, allowing an increase in the fuel pressure.

Although several embodiments of the present invention are described separately, any combination of the described embodiments can be applied to the fuel injection pump. For instance, a combination of the second and fifth embodiments, a combination of the third and fifth embodiments or a combination of the second and fourth embodiments can be applied to the fuel injection pump.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description. In the drawings:

What is claimed is:

1. A fuel injection pump comprising:

a reciprocal plunger;

a pump housing that includes a first cylindrical inner surface defining a fuel pressurizing chamber in sliding cooperation with said plunger, a second cylindrical inner surface defining a fuel passage that supplies fuel into said fuel pressurizing chamber or discharges said fuel from said fuel pressurizing chamber, and a connecting segment for connecting said first cylindrical inner surface to said second cylindrical inner surface; and stress spreading means that is arranged in said first cylindrical inner surface of said pump housing and contains intersecting points between said connecting segment and a longitudinal central axis of said connecting segment that extends through a center of said connecting segment in an axial direction of said fuel pressurizing chamber, wherein said stress spreading means spreads out stress generated in said intersecting points.

2. A fuel injection pump according to claim 1, wherein said stress spreading means is a flat section that extends perpendicular to an axis of said fuel passage.

3. A fuel injection pump according to claim 1, wherein said stress spreading means is a curved section having a radius of curvature that is greater than that of said first cylindrical inner surface.

4. A fuel injection pump according to claim 1, wherein said stress spreading means is arranged to contain an entire periphery of said connecting segment.

5. A fuel injection pump comprising:

a reciprocal plunger;

a pump housing that includes a first cylindrical inner surface defining a fuel pressurizing chamber in sliding cooperation with said plunger, a second cylindrical inner surface defining a fuel passage that supplies fuel into said fuel pressurizing chamber or discharges said fuel from said fuel pressurizing chamber, and a connecting segment for connecting said first cylindrical inner surface to said second cylindrical inner surface; and an increased radius section that extends perpendicular to an axis of said fuel passage, said increased radius section arranged in said first cylindrical inner surface of said pump housing and contains intersecting points between said connecting segment and a longitudinal central axis of said connecting segment that extends through a center of said connecting segment in an axial direction of said fuel pressurizing chamber, whereby said increased radius section disperses stress generated in said intersecting points from fuel in said fuel pressurizing chamber.

6. A fuel injection pump according to claim 5, wherein said increased radius section is a flat section.

* * * * *